US010794226B2

(12) United States Patent
Becker et al.

(10) Patent No.: US 10,794,226 B2
(45) Date of Patent: Oct. 6, 2020

(54) POWER PLANT WITH HEAT RESERVOIR

(71) Applicant: Siemens Aktiengesellschaft, Munich (DE)

(72) Inventors: Stefan Becker, Adelsdorf (DE); Erich Schmid, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/315,736

(22) PCT Filed: Jun. 26, 2017

(86) PCT No.: PCT/EP2017/065645

§ 371 (c)(1),
(2) Date: Jan. 7, 2019

(87) PCT Pub. No.: WO2018/024409

PCT Pub. Date: Feb. 8, 2018

(65) Prior Publication Data

US 2019/0301306 A1 Oct. 3, 2019

(30) Foreign Application Priority Data

Aug. 4, 2016 (DE) ..... 10 2016 214 447

(51) Int. Cl.
*F01K 3/00* (2006.01)
*F01K 3/06* (2006.01)
(Continued)

(52) U.S. Cl.
CPC ..... *F01K 3/004* (2013.01); *F01K 3/06* (2013.01); *F01K 3/14* (2013.01); *F01K 23/10* (2013.01); *F01K 23/106* (2013.01); *F01K 13/02* (2013.01)

(58) Field of Classification Search
CPC ..... F01K 17/025; F01K 7/16; F01K 19/10; F02C 7/224; F02C 6/18; F05D 2260/20;
(Continued)

(56) References Cited

U.S. PATENT DOCUMENTS 4,089,744 A 5/1978 Cahn
4,192,144 A * 3/1980 Pierce ..... F01K 3/00 122/28

(Continued)

FOREIGN PATENT DOCUMENTS

DE 102012102115 A1 8/2013
DE 102012108733 A1 3/2014

(Continued)

OTHER PUBLICATIONS

PCT International Search Report and Written Opinion of International Searching Authority dated Jan. 5, 2018 corresponding to PCT International Application No. PCT/EP2017/065645 filed Jun. 26, 2017.

*Primary Examiner* — Shafiq Mian
(74) *Attorney, Agent, or Firm* — Beusse Wolter Sanks & Maire

(57) ABSTRACT

A power plant having a steam circuit which can be supplied, in the region of a heat recovery steam generator, with thermal energy for producing steam, the steam circuit has, in the region of the heat recovery steam generator, a high pressure part, a medium pressure part and a low pressure part. In addition, a heat reservoir which has a phase change material and which is not situated in the region of the heat recovery steam generator is included, wherein, in order to supply the heat reservoir with thermally processed water, a supply line which leads out from the high pressure part or the medium pressure part is included and a discharge line which leads into the medium pressure part, the low pressure part or a steam turbine is included for discharging thermally processed water from the heat reservoir.

15 Claims, 4 Drawing Sheets

(51) Int. Cl.
*F01K 3/14* (2006.01)
*F01K 23/10* (2006.01)
*F01K 13/02* (2006.01)

(58) Field of Classification Search
CPC ..... F05D 2220/32; F05D 2220/60; F05D 2220/72
See application file for complete search history.

(56) References Cited

U.S. PATENT DOCUMENTS 9,638,173 B2 * 5/2017 Ehrsam ..... F03G 6/003
2011/0277469 A1 * 11/2011 Brenmiller ..... F03G 6/067 60/641.8
2012/0319410 A1 * 12/2012 Ambrosek ..... F28F 13/00 290/1 R
2014/0102073 A1 4/2014 Pang et al.
2014/0165572 A1 * 6/2014 Pang ..... F02C 7/224 60/736
2014/0238507 A1 * 8/2014 Bloch ..... B08B 3/02 137/377
2014/0366536 A1 * 12/2014 Muren ..... F03G 6/00 60/641.8
2015/0027122 A1 1/2015 Brunhuber et al.
2015/0219403 A1 * 8/2015 Olcese ..... F01K 3/008 60/641.8
2015/0267566 A1 9/2015 Vamvas
2015/0361883 A1 12/2015 Lenk et al.
2016/0356554 A1 * 12/2016 Mathur ..... B65B 5/06

FOREIGN PATENT DOCUMENTS

EP 2759680 A1 7/2014
JP H06146815A A 5/1994
JP H08260912 A 10/1996
JP 2000045713 A 2/2000
JP 2002106307 A 4/2002
JP 2002266606 A 9/2002
JP 2009097735 A 5/2009
JP 2014080975 A 5/2014
WO 2008107406 A2 9/2008
WO 2010070702 A1 6/2010
WO 2014026784 A1 2/2014
WO 2014095337 A2 6/2014
WO 2014096892 A1 6/2014
WO 2015043949 A1 4/2015

* cited by examiner

POWER PLANT WITH HEAT RESERVOIR

CROSS REFERENCE TO RELATED APPLICATIONS

This application is the US National Stage of International Application No. PCT/EP2017/065645 filed Jun. 26, 2017, and claims the benefit thereof. The International Application claims the benefit of German Application No. DE 10 2016 214 447.2 filed Aug. 4, 2016. All of the applications are incorporated by reference herein in their entirety.

FIELD OF INVENTION

The present invention relates to a power plant having a steam circuit which can be supplied, in the region of a heat recovery steam generator, with thermal energy for producing steam, and to a method for operating a power plant of said type.

BACKGROUND OF INVENTION

The present-day energy market requires power plants which permit flexible operation in order to be able to cover not only relatively fast start-up and run-down times but at the same time also a large power range. In particular because large fluctuations in supplied and demanded quantities of electricity may exist in the electrical supply networks, such power plants which can quickly output power to the supply networks or quickly take power therefrom are highly advantageous. The power plants should furthermore cover a large power range in order to be used both in peak load operation and in low part-load operation.

Owing to this requirement for fluctuating-load operation, it is sometimes also necessary for the power plant to be operated at standby, or removed from the network entirely, for periods of time. If the fastest possible start-up is to be performed proceeding from these states, the functional components of the steam circuit must be kept warm in order to keep thermal material fatigue as a result of thermal stresses low, in particular in the case of thick-walled components.

The prior art has disclosed various methods for storing thermal energy in a power plant process and returning said thermal energy into the power plant process. For example, WO 2014/026784 A1 discloses, for example, a power plant arrangement having a high-temperature reservoir unit which requires operating temperatures of over 600° C. DE 10 2012 108 733 A1 furthermore describes a system for generating hot water or steam by means of a high-temperature reservoir for use in a gas turbine power plant, in which system a storage material is situated in the high-temperature reservoir. EP 2 759 680 A1 has disclosed a gas turbine power plant with improved flexibility, wherein a heat reservoir and a vessel are provided such that hot water from the vessel can be supplied to the gas turbine during operation for the purposes of increasing power. US 2014/0165572 A1 moreover discloses a pre-warming device for combustion gas for a gas turbine using stored thermal energy.

It has hitherto been conventional, in the provision of peak loads for example by means of combined gas and steam power plants, to overfire the gas turbine, to open the compressor guide vanes to a great degree, or to perform a water injection into the intake air channel (so-called wet compression) or a steam injection into the combustion chamber of the gas turbine (so-called power augmentation). If relatively high outside temperatures prevail, the increase in power may also be achieved by virtue of the intake air for the gas turbine being cooled using evaporation coolers or refrigeration machines (so-called chillers). Likewise, the heat recovery steam generator (HRSG) may be equipped with an additional firing means in order to introduce further thermal energy into the steam circuit.

In the case of purely steam power plants, it is furthermore conventional, in the case of the steam generation, to maintain a power reserve of up to 5% of the peak load. If the peak load is then demanded, a corresponding increase in power can be offered.

When a thermal power plant has been shut down, for example in the case of a steam power plant, it is often the case that auxiliary steam from an auxiliary steam generator or from a neighboring plant is used to keep the functional components in the steam circuit warm. The auxiliary steam pressures are however relatively low, as a result of which, in turn, the temperatures for maintaining warmth are upwardly greatly limited.

Furthermore, the heat recovery steam generator generally requires relatively expensive natural gas or electrical energy for providing the required amounts of energy, for which reason this method has economic disadvantages.

Owing to these disadvantages, it is necessary to propose a more comprehensive technical power plant solution which not only ensures the flexibilization of the power plant but also makes it possible for the thermal functional components to be suitably kept warm while the power plant is in a standby mode or has been shut down.

SUMMARY OF INVENTION

These objects on which the invention is based are achieved by means of a power plant and by means of a method for operating a power plant of said type described above and below.

In particular, the objects on which the invention is based are achieved by means of a power plant having a steam circuit which can be supplied, in the region of a heat recovery steam generator, with thermal energy for producing steam, wherein the steam circuit comprises, in the region of the heat recovery steam generator, a high-pressure part, a medium-pressure part and a low-pressure part, and wherein, furthermore, a heat reservoir which has a phase change material (PCM) is included which is not arranged in the region of the heat recovery steam generator, wherein a supply line proceeding from the high-pressure part or the medium-pressure part is included for the supply of thermally treated water to the heat reservoir, and a discharge line is included for the discharge of thermally treated water from the heat reservoir, which discharge line opens into the medium-pressure part, the low-pressure part or a steam turbine.

Furthermore, the objects on which the invention is based are achieved by means of a method for operating a power plant of said type described above and below, which method comprises the following steps: —feeding thermally treated water from the high-pressure part or the medium-pressure part to the heat reservoir for charging purposes; —recirculating liquid water via the recirculation line to the medium-pressure part; —interrupting the feed of thermally treated water when a predetermined pressure or a predetermined temperature is attained in the heat reservoir; —after the interruption, discharging the stored water in the heat reservoir to the medium-pressure part, the low-pressure part or the steam turbine via the discharge line.

According to the invention, a heat energy reservoir concept is proposed which is integrated into the power plant.

The heat reservoir has, for the efficient storage of thermal energy, a carrier medium which performs only relatively small changes in volume during the introduction into storage, and release from storage, of the thermal energy. These materials, phase change materials (PCM), are integrated into the heat reservoir and permit the storage of relatively large amounts of thermal energy in a relatively small space. A supply is provided to the phase change material in the heat reservoir by steam from the high-pressure part or the medium-pressure part, whereby both the phase change material situated in the heat reservoir is thermally charged, and the heat reservoir itself can be filled for example with steam.

Here, the thermally charged phase change material ensures a substantially constant temperature level for as long as the temperature-induced phase change in the phase change material has not yet been fully completed. The thermal characteristics of phase change materials are well known to a person skilled in the art.

The phase change material may be present in the heat reservoir for example in encapsulated form, for example in spherical form, ovoid form, pellet-like form, in the form of short or long rods, etc., and is surrounded or flowed around by the steam from the high-pressure part or the medium-pressure part. It is thus possible for direct contact to occur between the steam and the possibly encapsulated phase change material.

At this juncture, it is pointed out that the high-pressure part, the medium-pressure part and the low-pressure part of the steam circuit may differ from one another owing to the prevailing temperatures or the pressure level in the steam circuit. Low-pressure part, medium-pressure part and high-pressure part may all have a dedicated pressure boiler, a dedicated economizer, a dedicated heat exchanger and a dedicated superheater or intermediate superheater. The expressions "high-pressure part", "medium-pressure part" and "low-pressure part" are general technical expressions and have long been used in power plant engineering. In particular, it is pointed out that these expressions cannot be used interchangeably.

Owing to the storage of thermal energy, in particular in conjunction with thermally treated or treatable steam, it is thus possible for load alterations of the power plant to be assisted. In particular in peak load operation, steam with a high energy content can be taken from the heat reservoir or treated therein and supplied to the steam turbine for the generation of electrical current. Owing to the addition of steam, a relatively greater amount of thermal energy, which can be converted in the steam turbine, is available for the energy generation.

It is likewise for example possible for steam to be taken from the heat reservoir or treated therein if it is sought to keep the functional components of the steam circuit warm, but without the heat recovery steam generator being fired at regular intervals or at all. In other words, the power plant can for example be in a standby mode or shut down, wherein thermal energy from the heat reservoir can nevertheless be available for keeping the thermal functional components of the steam circuit warm.

Owing to the high storable thermal energy density in the heat reservoir, which is made possible through the use of the phase change material, warmth can be maintained in a particularly advantageous manner from an energy aspect. An electrically operated or fuel-operated auxiliary steam generator is thus no longer necessary. Since the phase change material, after being charged, can provide a substantially consistent temperature level over relatively long periods of time, it is also possible for the steam in the heat reservoir, which thermally interacts with the phase change material, to be kept at a substantially uniform temperature level. This in turn ensures a relatively long supply of thermally conditioned water from the heat reservoir to the thermal functional components of the steam circuit.

In a first embodiment of the power plant according to the invention, provision is made for the heat reservoir to be designed as a pressure vessel in which the phase change material is arranged. Here, the phase change material may be present in individual pieces, such that it is in direct contact with thermally treated water or steam during the charging of the heat reservoir. Alternatively, it is also possible for the phase change material to be arranged for example around the pressure vessel, such that the transfer of heat between phase change material and water or steam takes place via the side walls of the heat reservoir. The phase change material serves to realize an increase in the heat capacity of the heat reservoir and thus for a relatively smaller construction.

The phase change material is self-evidently suitably adapted to the desired or prevailing temperatures in the heat reservoir. In other words, the temperature range of the phase change of the phase change material lies close to or at the required or desired storage temperature in the heat reservoir. This self-evidently also applies to all embodiments of the power plant according to the invention.

In a further embodiment of the invention, provision is made for the heat reservoir to have a sparger via which the thermally treated water from the supply line can be distributed in the heat reservoir. A sparger is in this case substantially a line assembly which has numerous small openings via which the thermally treated water can be distributed in the heat reservoir. The sparger ensures, during the introduction of the thermally treated water into the heat reservoir, the most uniform possible application of thermal energy to all regions of the heat reservoir, whereby, in particular, the rates of introduction into storage can be increased.

In a further embodiment of the invention, provision is made for the heat reservoir to have at least one pressure measuring device and/or one temperature measuring device. The charging and the discharging of the heat reservoir can thus be performed in a temperature-dependent and/or pressure-dependent manner. For this purpose, the power plant may furthermore also comprise for example a control valve in the supply line and in the discharge line, which make it possible to adjust the required flows and pressures. With the aid of more comprehensive suitable control, it is thus possible for the heat reservoir to be charged and discharged in a pressure-dependent and/or temperature-dependent manner. Such control may be integrated into the process control of the power plant.

In a further embodiment of the invention, provision is made for a flash tank to be connected into the discharge line, which flash tank permits a separation of vaporous and liquid water. By means of the flash tank, it is thus for example possible for vaporous fractions of the discharged water to be separated off and possibly supplied again to the steam circuit for further use. In particular, such a vaporous fraction can be introduced into the low-pressure part of the steam circuit in order to be available for further use.

In a further embodiment of the invention, provision is made for the supply line to proceed from an economizer or from a steam drum of the medium-pressure part. Accordingly, the heat reservoir can be supplied with relatively expediently thermally treated water, whereby charging of the heat reservoir can be performed at relatively low cost.

As an alternative to this, it is also conceivable for the supply line to proceed from an economizer or from a superheater of the high-pressure part. Since the high-pressure part provides water at considerably higher pressure or higher temperature, this embodiment is economically less advantageous than that above, but makes it possible for the heat reservoir to be charged to a higher pressure or a higher temperature level. Likewise, the thermally conditioned water possibly stored in the heat reservoir can be kept available in a still-utilizable form over a longer period of time.

It is furthermore conceivable for a recirculation line to be provided which at one side is fluidically connected to the heat reservoir and at the other side opens into the medium-pressure part at a location at which liquid water is conducted. This location is advantageously the steam drum or the feed water line. Via the recirculation line, it is thus possible for thermally enriched water to be discharged from the heat reservoir and introduced into the steam circuit again. In particular during the initial charging of the heat reservoir, during which steam compensation is performed, it is desirable for the condensed fractions to be recirculated into the steam circuit again, in particular at a location at which liquid water is likewise conducted. This is possible in particular in the medium-pressure part in the region of the steam drum or feed water line.

In an alternative embodiment of the invention, provision may be made for a recirculation line to also be provided which at one side is fluidically connected to the heat reservoir and at the other side opens into a flash tank from which a steam line leads into the low-pressure part. Additionally, it is also for example possible for a further liquid line to open into the low-pressure part at a location at which liquid water is conducted. Owing to the separation of vaporous and liquid fractions in the flash tank, it is thus possible for the low-pressure part to be supplied with vaporous and with liquid fractions of the thermally conditioned water. The use of the flash tank thus does not necessitate any phase-specific recirculation of thermally conditioned water in the recirculation line, because the vaporous phase can be separated from the liquid phase in the flash tank. As a result, it is for example possible for wet steam to be recirculated from the heat reservoir by the recirculation line to the low-pressure part.

In a further embodiment of the invention, provision is made for the power plant to furthermore have a steam superheater which is connected into the discharge line downstream of the heat reservoir and which likewise has a phase change material. Here, the steam superheater may for example also, like the heat reservoir, be designed as a combination of steam reservoir and integrated phase change material. An exemplary embodiment has, for example, the form of a reservoir box which is integrated into a standard container and which has suitable connection points for a supply line and discharge line. The supply of thermally treated steam out of the heat reservoir may in this case be realized in a variety of ways. Depending on operational requirements, it is for example possible for the supply to be configured such that, for example, produced saturated steam is introduced into the steam line of the medium-pressure part upstream of the superheater, or the superheated steam from the steam superheater is supplied into the line of the intermediate superheater between intermediate superheater heating surfaces. Other supply possibilities are conceivable depending on requirements. The use of the steam superheater furthermore increases the flexibility of the power plant and also makes it possible for superheated steam to be utilized inexpensively in the steam circuit.

In a first embodiment of the method according to the invention for operating the power plant, provision is made for the discharge of the stored water to be performed following a demand for secondary frequency support, and for the stored water to be discharged to the medium-pressure part between the steam drum and the superheater of the medium-pressure part. The discharged, thermally treated water from the heat reservoir is consequently thermally conditioned once again in the superheater of the medium-pressure part to such an extent that steam at an adequately high temperature level can be provided in order to increase the power operation of the steam turbine. Although, in part, thermal energy from the superheating process is utilized for the increase of power, a significant amount of thermal energy is nevertheless discharged from the heat reservoir for the increase of power.

In a further embodiment of the invention, provision is made for the discharge of the stored water to be performed upon the starting of the steam turbine, and for the stored water to be discharged directly to the steam turbine without firstly being conducted to the medium-pressure part or to the low-pressure part of the power plant. It is thus advantageous here for the discharged water to be thermally treated once again, for example through the provision of a further, second heat reservoir or steam superheater, which is connected into the discharge line and which once again releases thermal energy to the discharged water. Such a second heat reservoir may for example also be designed as a heat reservoir with phase change material.

In a further embodiment of the method according to the invention, provision may be made for the discharge of the stored water to be performed when the steam turbine is in a standby state in which the steam turbine is not outputting any power. The discharged water is advantageously thermally treated once again by means of a second heat reservoir and supplied for intermediate superheating. Here, the steam turbine is for example in a standby mode or is possibly even completely removed from the network. By means of the discharge of the water stored in the heat reservoir, it is thus possible for the thermal functional components of the steam circuit to be kept warm, wherein it is for example also possible for a minimum pressure to be provided. This in turn not only promotes the fast operational readiness of the steam circuit but also reduces thermal material fatigue.

In a further embodiment of the method according to the invention, provision is made for the discharge of the stored water to be performed when the steam turbine is under normal load, and for the stored water to be discharged to the medium-pressure part for the further increase of power. The discharged water thus serves for covering peak loads.

The invention will be described in more detail below on the basis of a number of figures. Here, it is pointed out that the technical features denoted by the same reference designations in the figures exhibit the same modes of operation.

It is furthermore pointed out that the figures are to be understood as being merely schematic, and in particular do not give rise to any restrictions with regard to practicability.

It is also to be noted that the technical features described below may be claimed in any desired combination with one another and in any desired combination with the embodiments of the invention described above, as long as the resulting solution can achieve the object on which the invention is based.

DETAILED DESCRIPTION OF INVENTION

Figure 1:
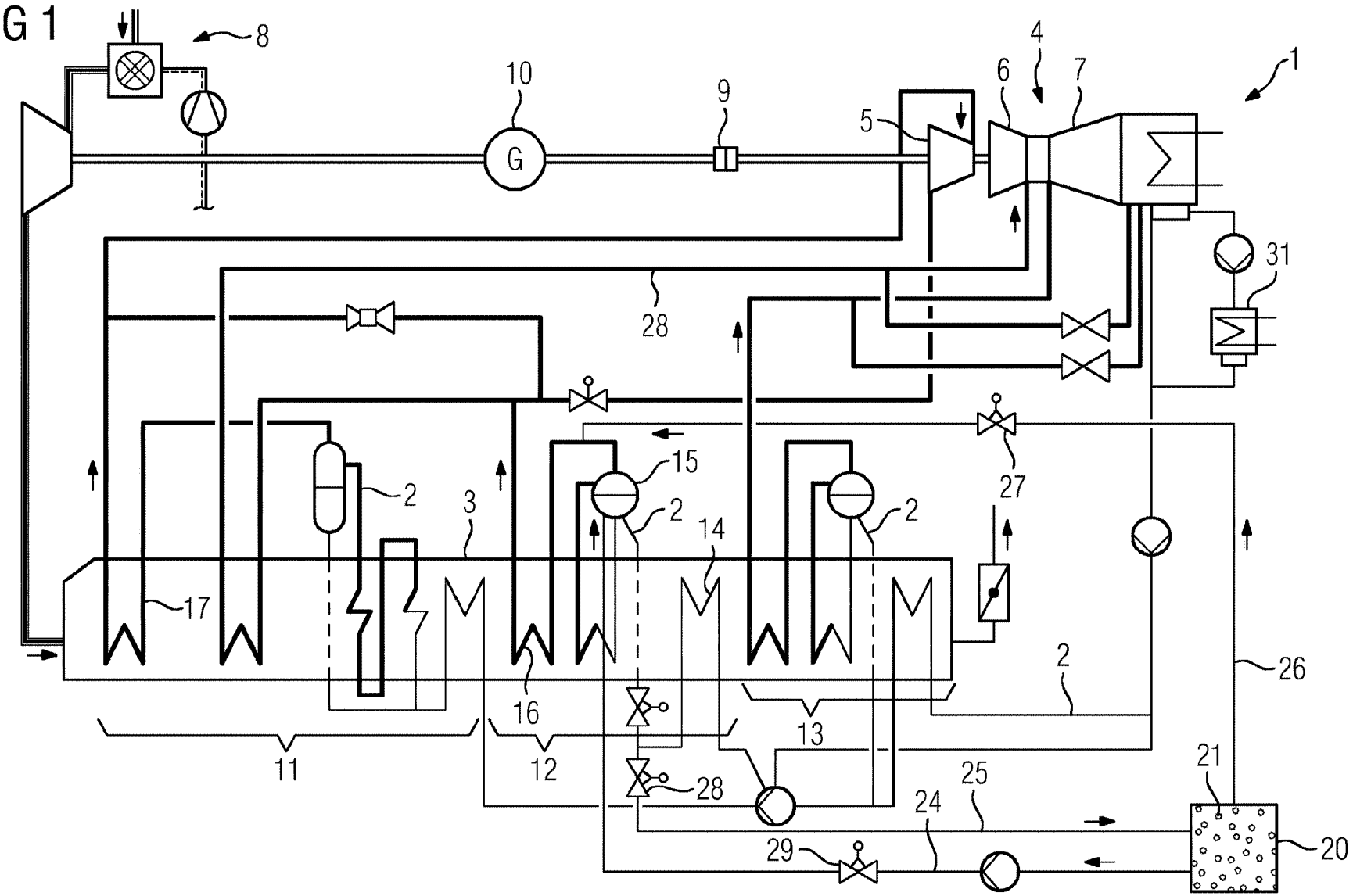
FIG. 1 shows a schematic diagram view of a first embodiment of the power plant 1 according to the invention.

FIG. 1 shows a schematic diagram view of an embodiment of the power plant 1 according to the invention, in which water in a steam circuit 2 is thermally treated by means of a heat recovery steam generator 3 in order to subsequently convert its thermal energy into rotational mechanical energy by means of a steam turbine 3. The heat recovery steam generator 3 is in particular supplied with thermal energy by means of the exhaust gas of a gas turbine 8, wherein those regions of the steam circuit 2 which are arranged relatively close to the gas turbine in terms of flow are at a relatively high temperature. Within the heat recovery steam generator 3, the individual heat exchangers 3 may be assigned to different regions. The region which has the highest temperatures and pressures is the high-pressure part 11; the part which has the next highest pressures and temperatures is the medium-pressure part 12; and the third part, the low-pressure part 13, has the lowest pressures and temperatures. Both the high-pressure part 11 and the medium-pressure part 12 and the low-pressure part 13 may have an economizer, a heat exchanger with steam drum, and an intermediate superheater or superheater. The individual pressure parts 11, 12, 13 are, correspondingly to the pressure and temperature level, connected to individual turbines of the multi-part steam turbine 4. Thus, the high-pressure part 11 is connected to a high-pressure steam turbine 5, the medium-pressure part 12 is connected to a medium-pressure steam turbine 6, and the low-pressure part 13 is connected to a low-pressure steam turbine 7. The individual steam turbines 5, 6, 7 are each connected to one another by means of a shaft, wherein the gas turbine 8 may for example be connected via a clutch 9 to the steam turbine 4 via said shaft. Likewise mechanically connected to the shaft is a generator 10, such that, when the rotational movement is performed, electrical power can be made available.

Furthermore, a heat reservoir 20 is included which has a phase change material 21 which is integrated into the heat reservoir 20. In particular, the phase change material 21 is in the form of individual pieces which are encapsulated, and which are for example present as a filling in the heat reservoir 20. For the thermal charging of the heat reservoir 20 together with the phase change material 21 situated therein, it is possible for firstly thermally treated water, for example in the form of steam, to be taken from the economizer 14 of the medium-pressure part 12 and supplied to the heat reservoir 20. For this purpose, the heat reservoir 20 is connected to the economizer 14 of the medium-pressure part 12 via a supply line 25, wherein the flow rate of thermally treated water taken from the medium-pressure part 12 can be adjusted by means of a supply line valve 28. During the charging process in the heat reservoir 20, condensation of the steam normally occurs, which precipitates for example as liquid water on the base of the heat reservoir 20. The condensed water, which may nevertheless still have a high thermal heat content, can be recirculated via a recirculation line 24 from the heat reservoir 20 into the steam drum 15 of the medium-pressure part 12 again. There, the recirculated water can be supplied for thermal treatment in the heat recovery steam generator 3 again. The loss of water from the steam circuit 2 can consequently be avoided.

When the heat reservoir 20 has been approximately fully charged, that is to say when the volume of the heat reservoir 20 has been approximately filled with steam, wherein the phase change material 21 is likewise present in fully charged form, the steam can be taken from the heat reservoir 20 again for example for the increase of power during operation of the power plant 1. Here, the steam is supplied, for example via a discharge line 26, to the medium-pressure part 12 in the region between the steam drum 15 and the superheater 16 of the medium-pressure part 12. The amount of supplied steam can in turn be adjusted by means of a discharge line valve 27 in the discharge line 26.

If, for example in the case of peak load operation, an increased output of electrical energy is required, the amount of steam additionally supplied to the medium-pressure part 12 can permit increased power operation of the steam turbine 4, whereby an increased amount of electrical power can be output by the generator 10.

Figure 2:
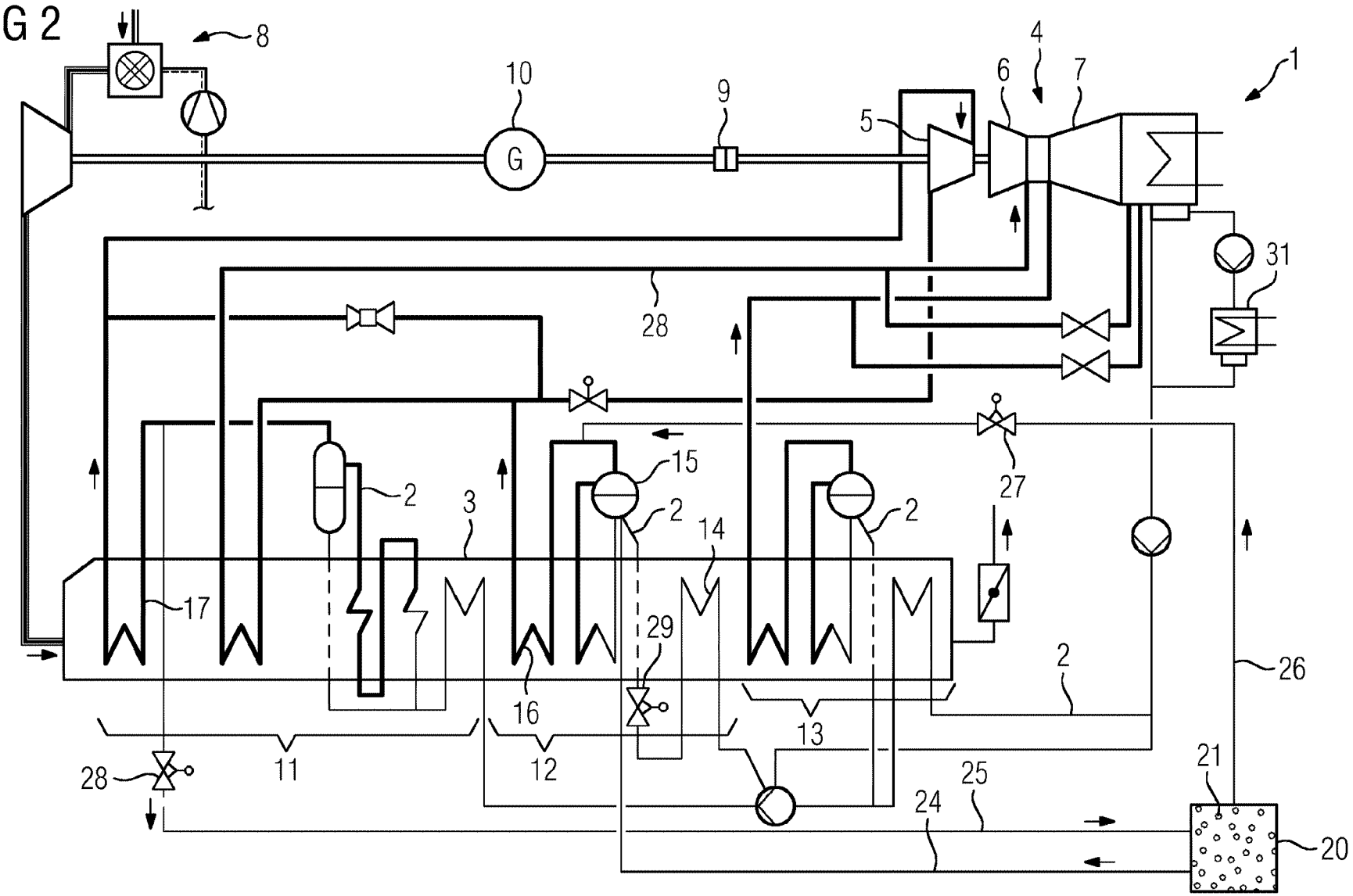
FIG. 2 shows a second embodiment of the power plant 1 according to the invention in a schematic diagram view.

FIG. 2 shows a further embodiment of the power plant 1 according to the invention in a schematic diagram view. Here, the basic construction of the steam circuit 2 of the power plant 1 is identical to the embodiment as per FIG. 1. Only the connection of the heat reservoir 20 differs insofar as the supply line is connected not to the medium-pressure part 12 but to the high-pressure part 11. Here, the connection is present directly upstream of the superheater 17 of the high-pressure part 11. As a result, the heat reservoir 20 can be charged with steam at a considerably higher temperature level and pressure level. This in turn results in a greater energy content in the heat reservoir 20, such that, during discharging via the discharge line 26 into the medium-pressure part 12, a relatively greater amount of energy can be discharged for the increase of power of the steam turbine 4.

Figure 3:
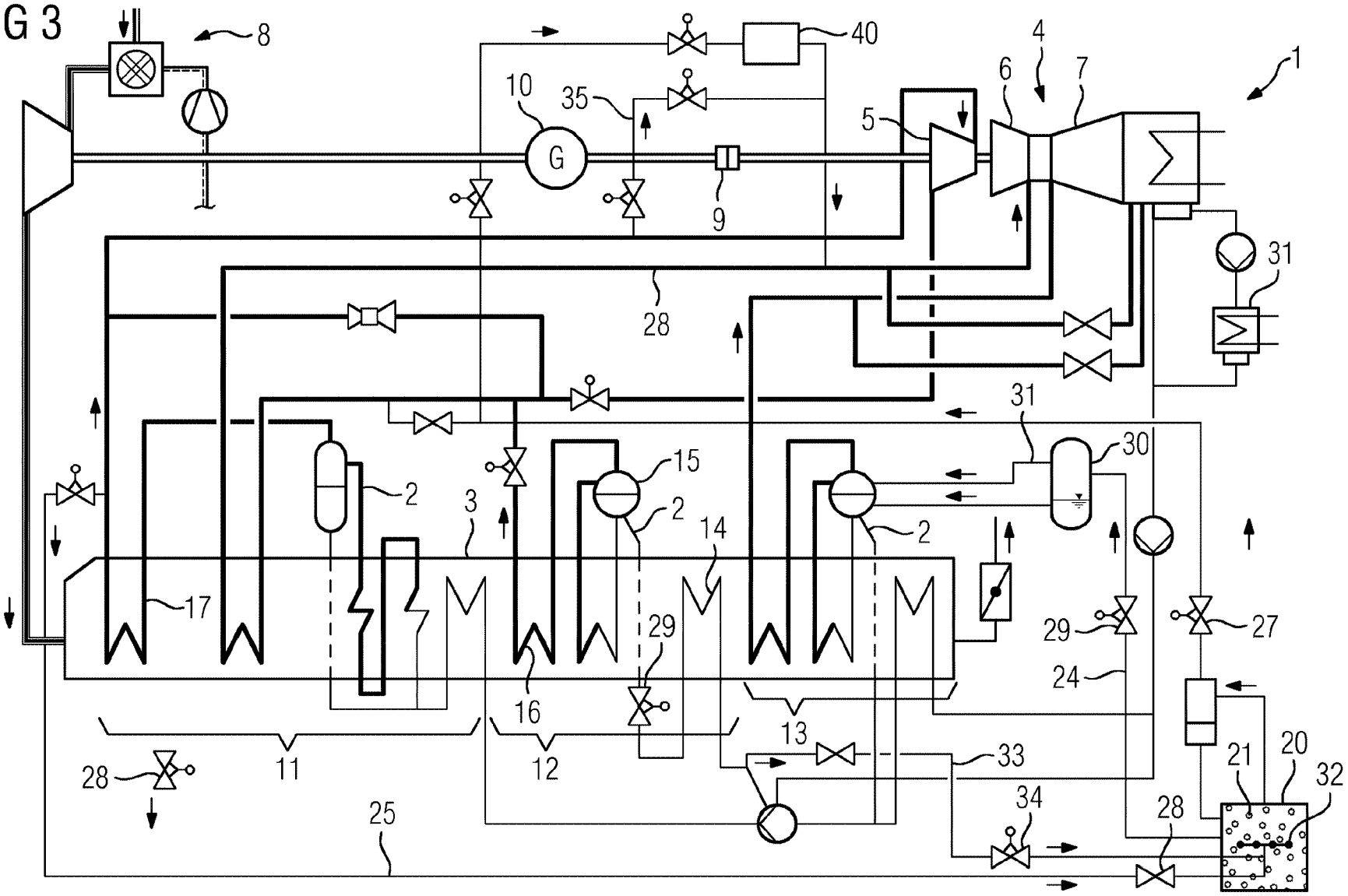
FIG. 3 shows a further, third embodiment of the power plant 1 according to the invention in a schematic diagram view.

FIG. 3 shows a further embodiment of the power plant 1 according to the invention, whose basic construction of the steam circuit 2 in turn is substantially identical to the preceding embodiments. By contrast, the heat reservoir 20 is designed as a steam pressure reservoir in which there is arranged a sparger 32 via which the steam supplied via the supply line 25 from the high-pressure part 11 can be distributed in a relatively uniform manner. The steam required for the charging of the heat reservoir 20 is in this case taken from the superheater 17 of the high-pressure part 11.

After high-pressure steam is taken from the steam circuit 2 and conducted into the heat reservoir 20, condensation of some fractions of the steam typically occurs, wherein this can be conducted via the recirculation line 24 to the low-pressure part 13. For the separation of the vaporous fractions and the liquid fractions before supply to the low-pressure part 13, the power plant 1 also has a flash tank 30, which is likewise connected into the return line 24. A steam line 31 leads away from the flash tank 30, which steam line is connected to the steam drum of the low-pressure part 13. At the same time, the liquid condensate in the flash tank 30 can likewise be supplied to the steam drum of the low-pressure part 13, but in a region in which the liquid phase of the water has accumulated.

For the further thermal charging of the heat reservoir, a water supply line 33 is also provided, which can discharge thermally treated water from the economizer of the medium-pressure part 12. The amount of water conducted here is adjusted by means of a water supply line valve 34 in the water supply line 33.

When thermal energy is taken from the heat reservoir 20, steam that has accumulated in the heat reservoir 20 is supplied via a flash valve, not denoted in any more detail with a reference designation, to a steam superheater 40, which is designed for example as a reservoir box. The steam emerging from said steam superheater 40 is subsequently conducted to the medium-pressure steam turbine 6 of the steam turbine 4. To supply yet further thermal energy to the steam taken from the steam superheater 40, the steam circuit has a bypass line 35 which mixes the steam discharged from the steam superheater 40 with steam from the superheater 17 of the high-pressure part 11. The steam superheater 40 is advantageously likewise designed as a heat reservoir with phase change material, wherein the thermal charging of said steam superheater 40 takes place substantially similarly to the charging of the heat reservoir 20. The required line portions or method steps are not described in any more detail in the present application but are evident to a person skilled in the art.

Figure 4:
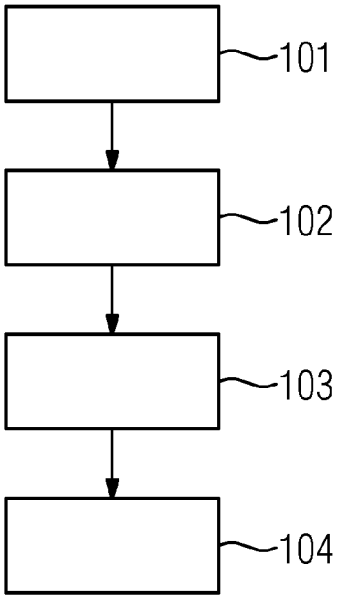
FIG. 4 is an illustration, in the form of a flow diagram, of an embodiment of the method according to the invention for operating a power plant.

FIG. 4 shows an embodiment of the method according to the invention for operating a power plant as described above, which method comprises the following steps: —feeding thermally treated water from the high-pressure part (11) or the medium-pressure part (12) to the heat reservoir (20) for charging purposes (first method step 101); —recirculating liquid water via the recirculation line (24) to the medium-pressure part (12) (second method step 102); —interrupting the feed of thermally treated water when a predetermined pressure or a predetermined temperature is attained in the heat reservoir (20) (third method step 103); —after the interruption, discharging the stored water in the heat reservoir to the medium-pressure part (12), the low-pressure part (13) or the steam turbine (4) via the discharge line (26) (fourth method step 104).

Further embodiments will emerge from the subclaims.

The invention claimed is:

1. A power plant comprising:

a steam circuit which is supplied, in a region of a heat recovery steam generator, with thermal energy for producing steam, wherein the steam circuit comprises, in the region of the heat recovery steam generator, a high-pressure part, a medium-pressure part and a low-pressure part, a heat reservoir which has a phase change material, which is not arranged in the region of the heat recovery steam generator, wherein the phase change material is different than water, a supply line proceeding from the high-pressure part or the medium-pressure part for the supply of thermally treated water to the heat reservoir, and a discharge line for a discharge of thermally treated water from the heat reservoir, and the discharge line opens into the medium-pressure part, the low-pressure part or a steam turbine.

2. The power plant as claimed in claim 1, wherein the heat reservoir is designed as a pressure vessel in which the phase change material is arranged.

3. The power plant as claimed in claim 1, wherein the heat reservoir has a sparger, and the thermally treated water from the supply line can be distributed in the heat reservoir via the sparger.

4. The power plant as claimed in claim 1, wherein the heat reservoir has at least one pressure measuring device and/or one temperature measuring device.

5. The power plant as claimed in claim 1, further comprising:

a flash tank is connected into the discharge line, and the flash tank permits a separation of vaporous and liquid water.

6. The power plant as claimed in claim 1, wherein the supply line proceeds from an economizer or from a steam drum of the medium-pressure part.

7. The power plant as claimed in claim 1, wherein the supply line proceeds from an economizer or from a superheater of the high-pressure part.

8. The power plant as claimed in claim 1, further comprising:

a recirculation line which at one side is fluidically connected to the heat reservoir and at an other side opens into the medium-pressure part at a location at which liquid water is conducted.

9. The power plant as claimed in claim 1, further comprising:

a recirculation line which at one side is fluidically connected to the heat reservoir and at an other side opens into a flash tank from which a steam line leads into the low-pressure part.

10. The power plant as claim 1, further comprising: a steam superheater is connected to the discharge line.

11. A method for operating a power plant as claimed in claim 1, the method comprising:

feeding thermally treated water from the high-pressure part or the medium-pressure part to the heat reservoir for charging purposes;

recirculating liquid water via the recirculation line to the medium-pressure part;

interrupting the feed of the thermally treated water when a predetermined pressure or a predetermined temperature is attained in the heat reservoir;

after the interruption, discharging the water stored in the heat reservoir to the medium-pressure part, the low-pressure part or the steam turbine via the discharge line.

12. The method for operating a power plant as claimed in claim 11, wherein the discharging of the stored water is performed following a demand for secondary frequency support, and the stored water is discharged to the medium-pressure part between a steam drum and the superheater of the medium-pressure part.

13. The method for operating a power plant as claimed in claim 11, wherein the discharge of the stored water is performed upon starting of the steam turbine, and the stored water is discharged directly to the steam turbine without firstly being conducted to the medium-pressure part or to the low-pressure part of the power plant.

14. The method for operating a power plant as claimed in claim 11, wherein the discharging of the stored water is performed when the steam turbine is in a standby state in which the steam turbine is not outputting any power.

15. The method for operating a power plant as claimed in claim 11, wherein the discharging of the stored water is performed when the steam turbine is under normal load, and the stored water is also discharged to the medium-pressure part for further increase of power.

* * * * *